US006462324B1

(12) United States Patent
Wright et al.

(10) Patent No.: US 6,462,324 B1
(45) Date of Patent: Oct. 8, 2002

(54) PHOTOMULTIPLIER TUBE WITH AN IMPROVED DYNODE APERTURE MESH DESIGN

(75) Inventors: Joseph Warren Wright, Lancaster; Anita Sreepadraj Venkatarao, Macungie; Sanders Carl McComsey, Lancaster, all of PA (US)

(73) Assignee: Burle Technologies, Inc., Wilmington, DE (US)

( * ) Notice: Subject to any disclaimer, the term of this patent is extended or adjusted under 35 U.S.C. 154(b) by 0 days.

(21) Appl. No.: 09/456,581

(22) Filed: Dec. 8, 1999

(51) Int. Cl.[7] ..... H01J 43/06
(52) U.S. Cl. ..... 250/207; 313/532
(58) Field of Search ..... 250/207; 313/532, 313/533, 534, 535, 536, 214 VT

(56) References Cited

U.S. PATENT DOCUMENTS

| | | | | | |
|---|---|---|---|---|---|
| 4,006,376 | A | | 2/1977 | Faulkner et al. | |
| 4,060,747 | A | | 11/1977 | Faulkner | |
| 4,112,325 | A | | 9/1978 | Faulkner | |
| 4,306,171 | A | * | 12/1981 | Faulkner et al. | 313/95 |
| 4,431,943 | A | | 2/1984 | Faulkner et al. | |
| 4,456,852 | A | * | 6/1984 | Faulkner et al. | 313/348 |
| 4,649,268 | A | | 3/1987 | Persyk | |
| 4,710,675 | A | | 12/1987 | Stephenson | |
| 4,825,066 | A | | 4/1989 | Nakamura et al. | |
| 5,043,628 | A | * | 8/1991 | Boutot et al. | 313/532 |
| 5,598,061 | A | * | 1/1997 | Nakamura | 313/532 |
| 5,616,987 | A | | 4/1997 | Ohmura et al. | |
| 5,914,561 | A | * | 6/1999 | Venkatarao | 313/533 |

FOREIGN PATENT DOCUMENTS

GB 2106708 4/1983

OTHER PUBLICATIONS

Iijima et al., "Study on fine–mesh PMTs for detection of aerogel Cherenkov light", *Nucl. Instr. and Meth. in Phys. Res. A 387*, (1997) pp. 64–68).

Hearty, "Detection of small light pulses and pulse height resolution of a fine mesh photomultiplier tube", *Nucl. Instr. and Meth. in Phys. Res. A 376*, (1995), pp. 83–87.

Suzuki et al., "New Mesh PMTS For High Magnetic Environments", *IEEE Transactions on Nuclear Science*, vol. 33, No. 1, Feb. 1986, pp. 377–380.

* cited by examiner

*Primary Examiner*—Stephone Allen
*Assistant Examiner*—Bradford Hill
(74) *Attorney, Agent, or Firm*—Dann, Dorfman, Herrell and Skillman, P.C.

(57) ABSTRACT

A photomultiplier tube includes a photocathode and a primary dynode having input and output apertures. A field isolating mesh is positioned at the input aperture of the primary dynode to facilitate the collection of electrons from the photocathode of the photomultiplier to the primary dynode while simultaneously electrostatically shielding secondary emission electrons from the field of the photocathode. The field isolating mesh has a central opening that is dimensioned to maximize the throughput of photoelectrons from the photocathode to the primary dynode while providing effective field isolation in the vicinity of the primary dynode. The central opening in the field isolation mesh provides the further advantage of permitting uniform deposition of photo-emissive materials on the surface of the dynode during manufacture. In an alternative embodiment, the field isolating mesh of the primary dynode is formed in two segments. The first segment is disposed in the input aperture of the primary dynode and the second segment is disposed in offset, spaced parallel relation to the first segment. The photomultiplier according to the disclosed invention provides a significant improvement in electron collection efficiency, pulse height resolution, and magnetic sensitivity compared to known photomultiplier tubes of otherwise similar construction.

18 Claims, 4 Drawing Sheets

PHOTOMULTIPLIER TUBE WITH AN IMPROVED DYNODE APERTURE MESH DESIGN

FIELD OF THE INVENTION

This invention relates to photomultiplier devices for the detection of radiant energy. More specifically, this invention relates to a photomultiplier having a field isolation mesh that is configured to improve the electron collection efficiency of its associated dynode and the pulse height resolution and magnetic sensitivity of the photomultiplier.

BACKGROUND OF THE INVENTION

A photomultiplier device conducts and amplifies radiant energy by way of a photocathode adapted to release electrons in response to radiation, such as light, incident thereon. The photomultiplier device amplifies the incident radiation by channeling the electrons released from the photocathode through an array of secondary dynodes. Each secondary dynode has an emission surface area that is responsive to electrons incident thereon by releasing a plurality of secondary electrons for each electron impinging on the emission surface of the secondary dynode. The secondary dynodes are arrayed or aligned in cascade such that the secondary electrons emitted in one dynode are transported sequentially to the other dynodes. In this way, multiplication of the photoelectrons released from the photocathode is accomplished, thereby amplifying the initially received radiation energy.

Photoelectrons are channeled first from the photocathode of the photomultiplier to the input of a primary dynode. The dynodes, including the primary dynode, have field isolating mesh or grid sections disposed about their input apertures. The field isolating mesh sections are typically formed of electrically conductive material and may be energized at the same electrical potential as the secondary emission surface of the dynode with which it is associated. The mesh functions to draw primary electrons toward the secondary mission surface while simultaneously electrostatically shielding the secondary mission electrons from the field of the photocathode or next preceding dynode. Thus, secondary emission electrons are channeled away from the input aperture of a dynode to the output surface of the dynode. The electrons passed from the last dynode output aperture of the array are collected by an anode, providing an amplified radiant energy signal.

As can be appreciated, field isolation among dynodes is necessary for the proper functioning of the photomultiplier device. Yet, the physical structure of the known dynode mesh sections limits the efficient performance of electron multiplication. For example, the conductive members of the mesh partially obstruct the path of traveling electrons to the input aperture, which adversely affects the electron collection efficiency of the dynode and the uniformity of secondary electron emissions produced. Moreover, this obstruction impedes the uniform coating of secondary emissive materials on a dynode surface during the manufacturing process.

It is known to utilize proximity-varied density configurations with secondary dynode mesh sections to increase electron transfer efficiency and to facilitate shielding of secondary dynode walls and output apertures, such an arrangement is shown and described in U.S. Pat. No. 4,112,326. However, such non-uniform configurations fail to address the poor collection efficiency between the photocathode and the first or "primary" dynode and the lack of uniformity in secondary electron emissions released therefrom. Moreover, the known mesh configurations do not facilitate the uniform coating of the primary dynode with secondary emissive materials during the manufacturing process.

Presently, a photomultiplier is desired wherein the primary dynode field isolation mesh is dimensioned to provide a significant improvement in the primary dynode electron collection efficiency, magnetic sensitivity, as well as the pulse height resolution of the photomultiplier.

SUMMARY OF THE INVENTION

In accordance with a first aspect of the present invention, there is provided a photomultiplier tube which includes an envelope having a faceplate. A photocathode disposed in the envelope receives radiant energy incident on the faceplate of the envelope and provides photoelectrons in response thereto in the known manner. A first dynode, also disposed in the envelope has an input aperture, an output aperture, and a secondary emissive surface formed between said input and output apertures. The input aperture faces the photocathode and the secondary emissive surface is oriented for receiving the photoelectrons from the photocathode. A field isolating mesh is positioned over the input aperture of the first dynode. The field isolating mesh includes a periphery formed of an electrically conductive material and a central opening. The periphery provides an isolating electric field in the vicinity of the input aperture of the first dynode when energized. The central opening is dimensioned to provide a maximum throughput of photoelectrons from said photocathode to the secondary emissive surface of the first dynode.

In accordance with a further aspect of this invention, the field isolating mesh is formed of two segments including a first segment that is positioned in the input aperture of the first dynode. The second segment is disposed in parallel spaced relation to the input aperture and said first segment. In use, the first segment is energized at the same electric potential as the first dynode and the second segment is energized at a different electric potential, usually that of the focusing electrode used in the photomultiplier tube for focusing the photoelectrons from the photocathode onto the first dynode.

Both of the foregoing arrangements provide a significant increase in the collection efficiency of the first dynode. As a result, the pulse height resolution of a photomultiplier tube in accordance with this invention is significantly improved relative to known devices. Furthermore, the magnetic sensitivity of the photomultiplier tube according to this invention is superior to the known photomultipliers.

BRIEF DESCRIPTION OF THE DRAWINGS

The foregoing summary, and the following detailed description, will be better understood when read in conjunction with the attached drawings, in which.

DETAILED DESCRIPTION OF THE PREFERRED EMBODIMENTS

Figure 1:
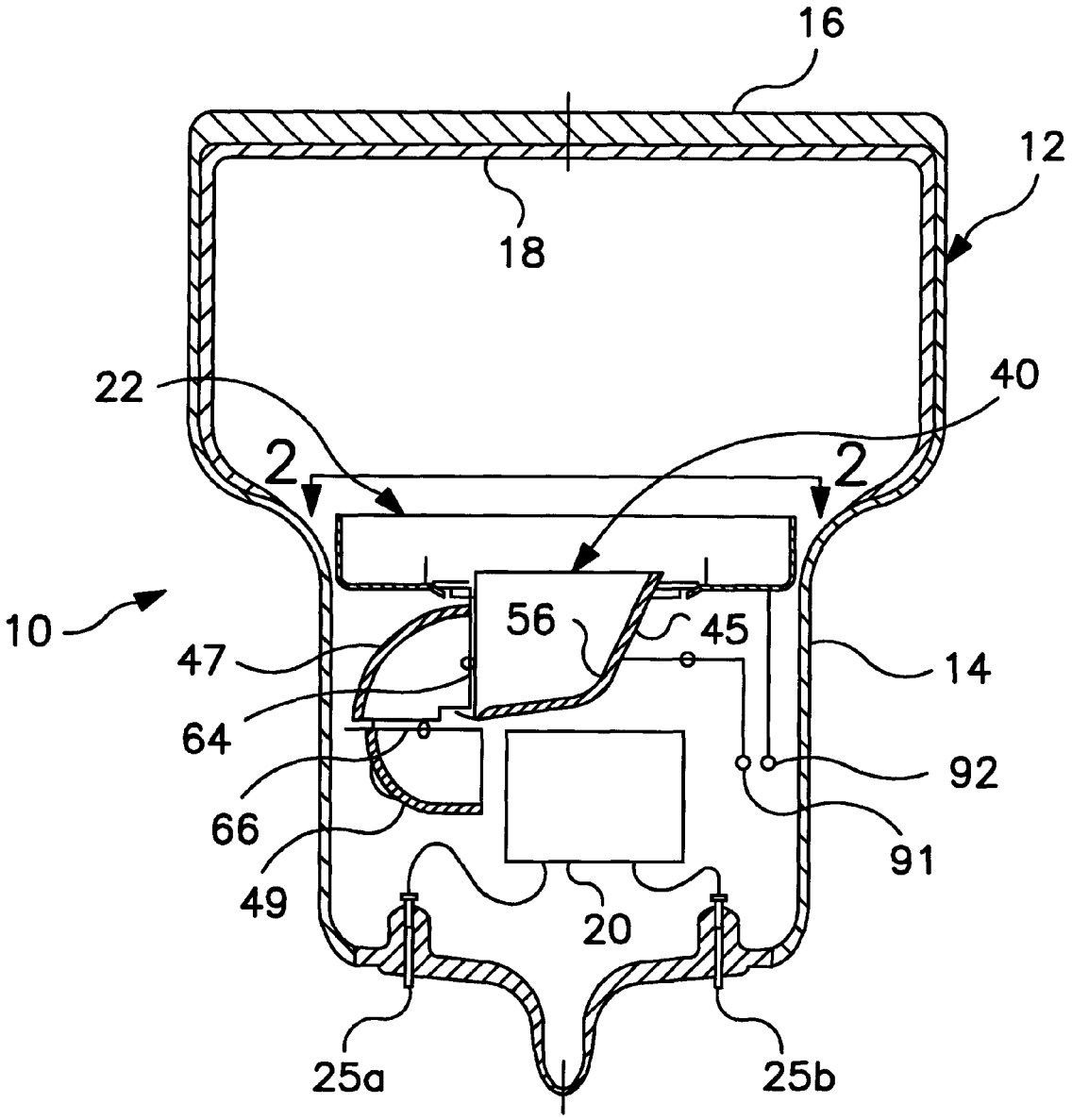
FIG. 1 is a side elevational view in partial section of a photomultiplier tube in accordance with the present invention.

Referring now to the drawings wherein like reference numerals refer to the same or similar components across the several views, and in particular to FIG. 1, there is shown a photomultiplier tube 10 in accordance with the present invention. Photomultiplier tube 10 includes an evacuated envelope or vessel 12 which has a cylindrical wall 14 and a light-transmitting faceplate 16. A photocathode 18 is formed on the interior surface of the faceplate 16 and on a portion of the interior surface of cylindrical wall 14. Light incident on the faceplate 16 enters the envelope 12 and photocathode 18 emits a plurality of photoelectrons in response to the incident light.

Arranged in the interior of envelope 12 is a first dynode array including a first or "primary" dynode 45, a second dynode 47, and a third dynode 49. In the embodiment illustrated in FIG. 1, dynodes 45, 47, and 49 are configured as box-and-grid dynodes, but other known or novel configurations could be used as well.

Photomultiplier tube 10 also has a second dynode array 20 which includes an anode (not shown). The second dynode array 20, is preferably configured as an in-line dynode array, such as that disclosed in a co-pending U.S. application Ser. No. 08/916,097 filed Aug. 21, 1997 (U.S. Pat. No. 5,914,561). However, the second dynode array is not limited to such a configuration because other known or novel configurations can be used depending on the particular design requirements. In general, the dynodes of the secondary dynode array 20 are constructed and arranged relative to one another in any suitable manner to facilitate the transfer of the stream of electrons from the first dynode array to the anode. The anode is connected to output terminals 25*a* and 25*b* for providing a signal from the photomultiplier device 10 to appropriate electronic instrumentation.

The first dynode 45 has an input aperture that is oriented for receiving photoelectrons from the photocathode 18. An output aperture is formed at the opposite end of first dynode 45 through which the secondary electrons are transmitted to the second dynode 47. A secondary emission surface 56 is disposed between the input aperture and the output aperture. As known to those skilled in the art, the secondary emission surface of the dynodes is responsive to the photoelectrons incident thereon for releasing a plurality of secondary electrons.

The dynodes 45, 47, and 49, and the dynodes of the second dynode array 20 are formed of a suitable conductive material, including, but not limited to, such metals as nickel or stainless steel. The active or emissive surface of each dynode is coated with a suitable secondary emitter material, including, but not limited to, such materials as cesium antimonide ($Cs_2Sb$), potassium cesium antimonide ($K_2CsSb$), gallium phosphide, gallium arsenide phosphide, beryllium oxide (BeO:Cs), magnesium oxide (MgO:Cs), or silver oxide (AgO:Cs).

In order to facilitate the transfer of electrons from the photocathode 18 to the primary dynode 45 of the first array, the photomultiplier includes a focusing electrode 22. The focusing electrode 22 is disposed between the photocathode 18 and the inlet aperture of the primary dynode 45. When energized, the focusing electrode 22 orients or "focuses" the photoelectrons released from peripheral regions of photocathode 18 onto the secondary emission surface 56 of primary dynode 45. The focusing electrode 22 does not amplify the electron signal between the photocathode 18 and the primary dynode 45. However, its structure can be arranged to provide a maximum electron transfer from the photocathode 18 to the primary dynode 45. A field isolation mesh 40 is disposed over the input aperture of primary dynode 45. Preferably, a field isolation mesh 64 is positioned in the inlet aperture of the second dynode 47 and a field isolation mesh 66 is positioned in the inlet aperture of the third dynode 49.

Figure 2:
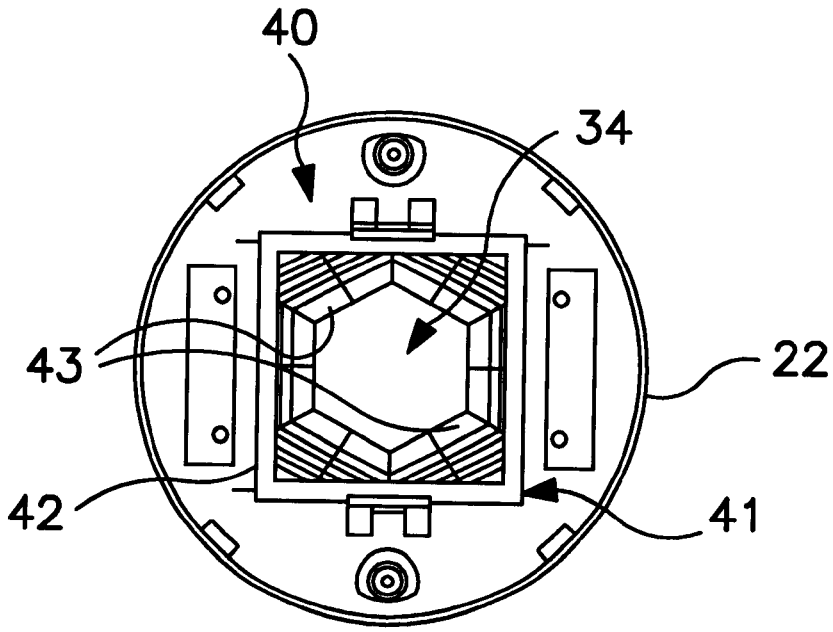
FIG. 2 is a plan view of a field isolating mesh for the primary dynode of the photomultiplier of FIG. 1 as viewed along line 2–2 therein.

Referring now to FIG. 2, there is shown a first embodiment of a primary dynode field isolation mesh 40 in accordance with the present invention. The isolation mesh 40 has a ring-shaped periphery 41 formed of a conductive material, preferably nickel, stainless steel, or other suitable metal. The periphery 41 includes a support ring 42 and a grid 43 extending inwardly from the support ring 42. The isolation mesh 40 does not provide any electron multiplying function and, therefore, is not purposely coated with a secondary emitter material. However, it may be coated circumstantially by virtue of its presence in the photomultiplier tube during photocathode processing. The support ring 42 and the grid 43 are configured and arranged so that when energized, they provide an electric field that isolates the inlet aperture of primary dynode 45 from the electric field of photocathode 18. In this manner electrons released from secondary emission surface 56 are more readily channeled towards the outlet aperture of primary dynode 45.

Figure 3:
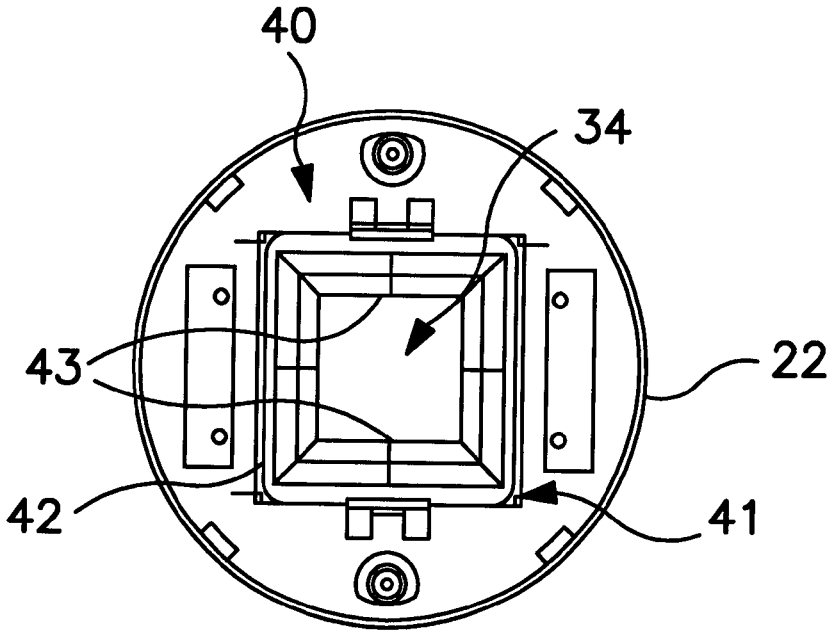
FIG. 3 is a plan view of a second configuration for a field isolating mesh of the type shown in FIG. 2.

Isolation mesh 40 has a central opening or aperture 34 formed by the inner circumference of the grid 43. The central opening 34 can have any suitable geometry, including polygonal and circular geometries. Referring to FIG. 2, there is shown an isolation mesh 40 having a hexagonal central aperture 34. Shown in FIG. 3 is an isolation mesh 40 having a substantially square central opening 34. Regardless of the geometry used, the central opening 34 is dimensioned to provide a maximum, unobstructed line of sight to the surface 56 from a point outside of the inlet aperture of primary dynode 45. That arrangement maximizes the unobstructed throughput of photoelectrons from the photocathode 18 to the secondary emission surface 56 of primary dynode 45. In a similar manner, the size and shape of central opening 34 is selected to provide uniform, unobstructed transfer of the secondary emitter material to the primary dynode 45 during manufacturing of the photomultiplier tube 10. The unobstructed, line-of-sight path permits a substantially uniform coating of the secondary emission materials on the dynode surface 56.

The central opening 34 may not be so large that it effectively eliminates the field isolation provided by the field isolation mesh 40. There does not appear to be any effective limit on the minimum size of the central opening so long as it is large enough to provide the desired functionality. Those skilled in the art can readily determine the minimum and maximum limits for a given photomultiplier by appropriate testing, for example, or by computer simulation. In accordance with this invention, the central opening may be offset toward the outlet aperture of primary dynode 45 or away therefrom with results similar to those obtained with a centralized location of the opening 34. Those skilled in the art can also readily determine the limits of such offsetting In the operation of photomultiplier tube 10, the primary dynode 45 is energized at a first voltage $v_1$ by way of terminal 91 which is connected to an external voltage source (not shown). Also during operation of the photomultiplier tube 10 in accordance with this invention, the focus electrode 22 is energized at a second voltage $v_2$ by way of terminal 92 which is connected to a second external voltage source (not shown). The voltage $v_2$ applied to focus electrode 22 is set at a lower electric potential relative to the voltage $v_1$ applied to the primary dynode 45. In the embodiment shown in FIG. 1, the field isolation mesh 40 is in physical contact with the primary dynode 45 and therefore is energized at the voltage $v_1$.

Figure 4:
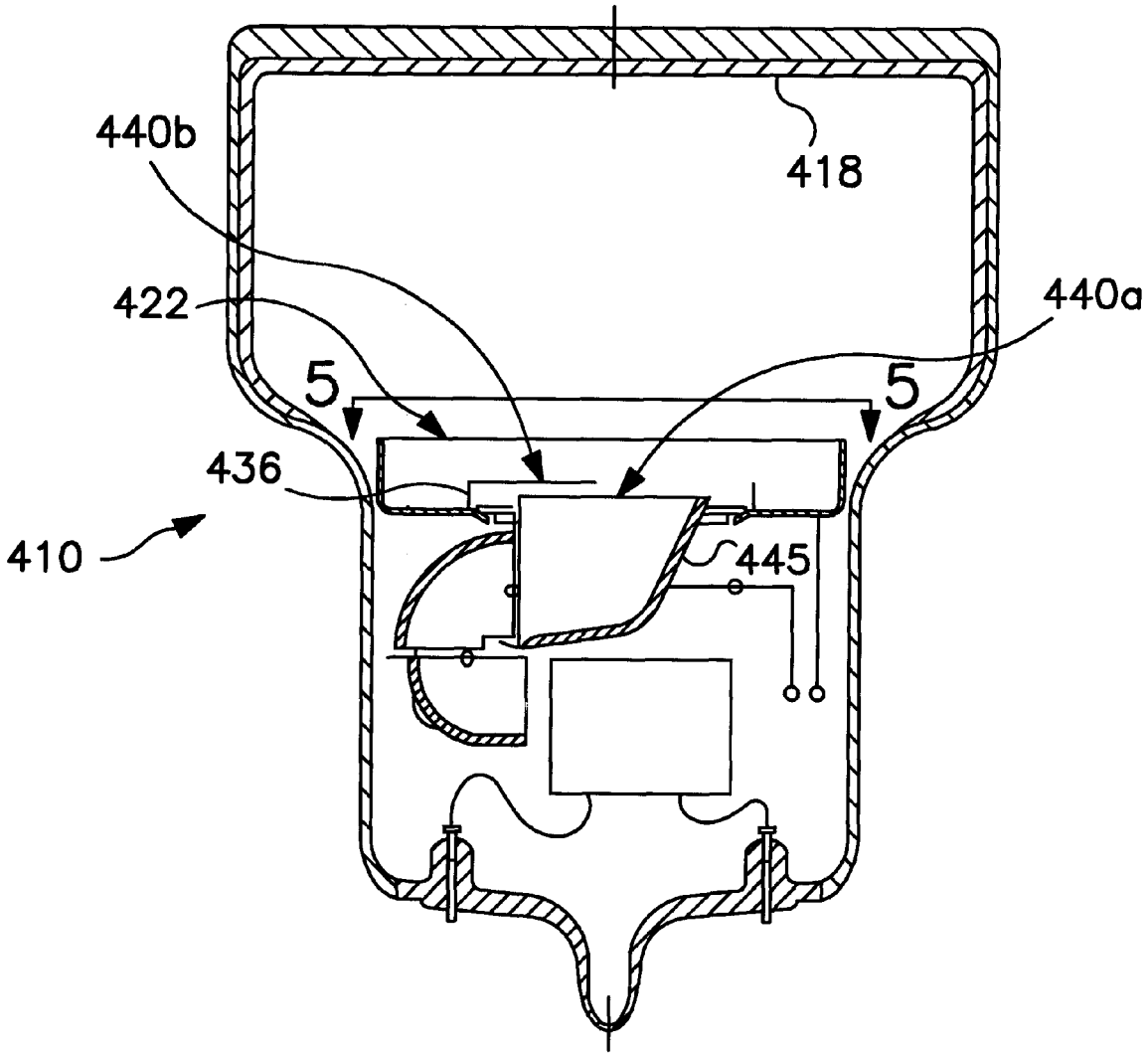
FIG. 4 is a side elevational view in partial section of a second arrangement of a photomultiplier tube in accordance with the present invention.
Figure 5:
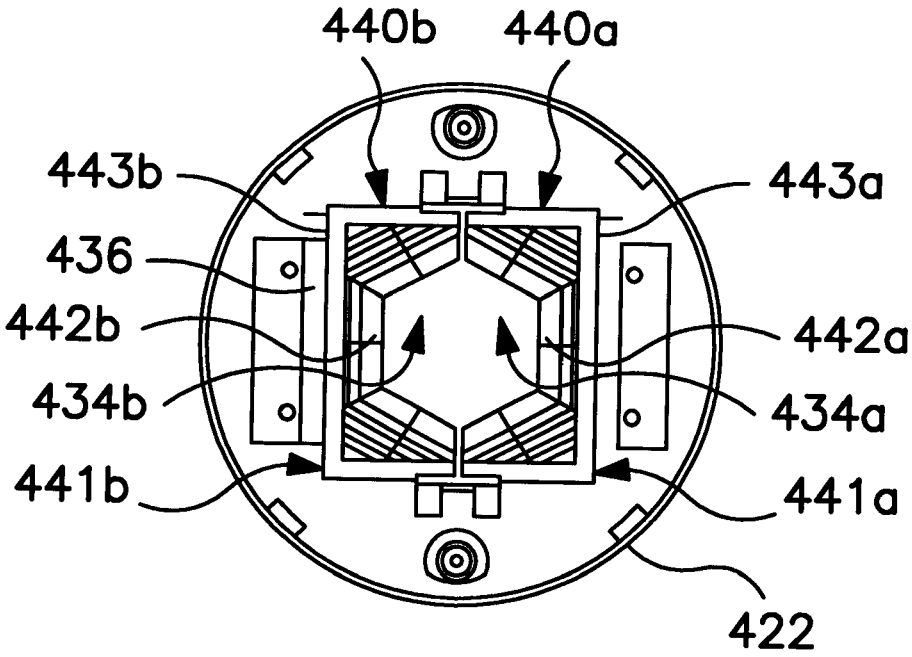
FIG. 5 is a plan view of a field isolating mesh for the primary dynode of the photomultiplier of FIG. 4 as viewed along line 5–5 therein.
Figure 6:
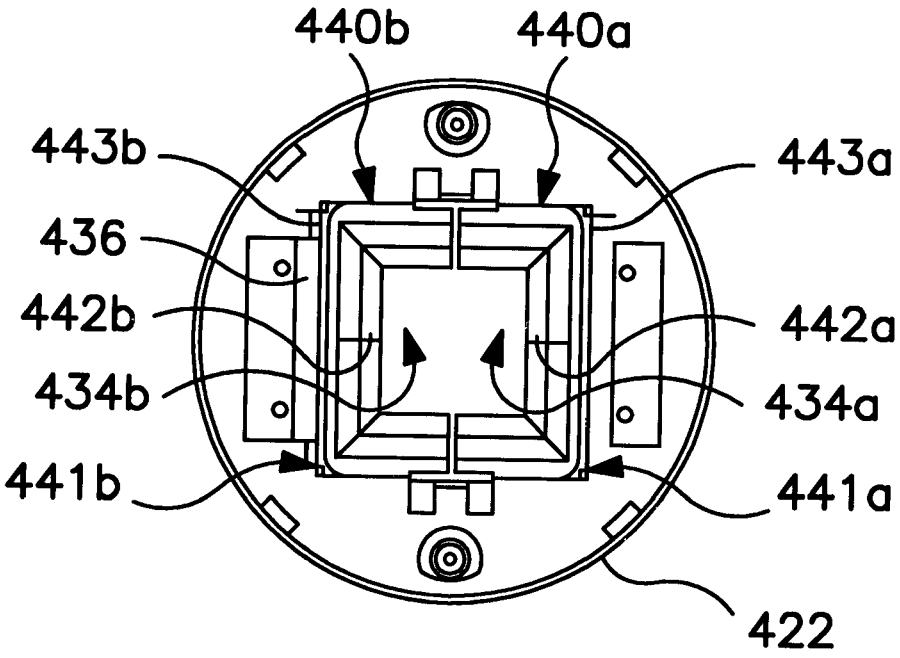
FIG. 6 is a plan view of a second arrangement for a field isolating mesh of the type shown in FIG. 5.

Referring now to FIG. 4, there is shown a photomultiplier device 410 in accordance with another aspect of the present invention. The photomultiplier 410 includes all of the same components as the embodiment shown in FIG. 1 and described hereinabove. However, in the photomultiplier 410, the field isolation mesh is formed in two symmetrical segments 440*a* and 440*b*. Mesh segment 440*a* is attached to primary dynode 445 in the usual manner. Mesh segment 440*b* is attached to a bracket 436 on the focusing electrode 422. Because of that arrangement, mesh segment 440*b* is in spaced parallel relation to mesh segment 440*a*. However, when viewed from the photocathode 418, as shown in FIGS. 5 and 6, the mesh segments 440*a* and 440*b* appear to be coplanar and thus function in the same way as the field isolation mesh shown in FIG. 1 and described hereinabove.

Mesh segment 440*a* has a periphery 441*a* that includes a grid 442*a* and a support rail 443*a* therefor. Similarly, mesh segment 440*b* has a periphery 441*b* that includes a grid 442*b* and a support rail 443*b* therefor. The mesh segments 440*a* and 440*b* have respective cut-out sections 434*a* and 434*b* formed therein. When the mesh segments 440*a* and 440*b* are assembled in the photomultiplier tube 410, the cut-out sections 434*a* and 434*b* combine to form a central opening in the field isolation mesh. This central opening provides the same functionality as that described for the embodiment of FIG. 1. However, in the embodiment shown in FIG. 4, because the mesh segment 440*a* is attached to the primary dynode 445, it is energized at the voltage $v_1$ and because the mesh segment 440*b* is attached to the focusing electrode 422, it is energized at the voltage $v_2$. The net electric field resulting from the difference in electrical potential between mesh segments 440*a* and 440*b* has been found to provide further improvement in electron collection efficiency of the primary dynode 445.

A photomultiplier tube having improved electron collection efficiency, pulse height resolution, and magnetic sensitivity has been described herein. The photomultiplier of the present invention includes a primary dynode having input and output apertures, the input aperture functioning to channel photoelectrons released by the photocathode to the active surface of the primary dynode. An appropriately energized focusing electrode directs the photoelectrons emitted by the photocathode towards, and into the input aperture of, the primary dynode 445. A field isolating mesh is positioned about the input aperture of the primary dynode to facilitate the collection of electrons directed away from the photocathode of the photomultiplier to the primary dynode while simultaneously electrostatically shielding secondary emission electrons from the field of the photocathode. The primary dynode mesh has a central opening formed therein which is dimensioned to provide an unobstructed path to the active surface of the dynode for photoelectrons emitted by the photocathode and for photo-emissive material to be deposited on the surface of the dynode.

In an alternative embodiment, the field isolating mesh of the primary dynode is formed of two symmetrical segments. The first mesh segment is mounted on the primary dynode in the usual manner and the second mesh segment is mounted on the focusing electrode of the photomultiplier and is disposed in spaced parallel relation to the first mesh segment. The first mesh segment is energized at the same electrical potential as the first dynode and the second mesh segment is energized at the electric potential of the focusing electrode. The potential difference between the first and second mesh segments provides a net electric field that further enhances the electron collection efficiency of the first dynode.

Those skilled in the art will be able to utilize other primary dynode arrangements that provide desired transfer and collection characteristics for various dynode mesh arrangements in accordance with the present invention. In addition to the embodiments of the field isolating mesh described and shown herein, it is also contemplated that the central aperture of the field isolating mesh of the first dynode can be constructed in a variety of geometric shapes, including circles and polygons other than those specifically described herein. Any shape that permits unobstructed movement of photoelectrons through the mesh is acceptable. It is further contemplated that the field isolating meshes of the other dynodes in the photomultiplier can be formed with a similar central opening. It is believed that the use of such additional meshes will further enhance the pulse height resolution and magnetic sensitivity of the photomultiplier. Further still, potentials other than $v_1$ and $v_2$, described above, can be applied to the split mesh embodiment if appropriate means are taken to isolate the mesh segments from the supporting structures, i.e., the focusing electrode 22 and primary dynode 45, respectively.

It will be recognized by those skilled in the art that changes or modifications may be made to the above-described invention without departing from the broad inventive concepts of this invention. It is understood, therefore, that the invention is not limited to the particular embodiments disclosed herein, but is intended to cover all modifications and changes which are within the scope of the invention as defined in the appended claims.

What is claimed is:

1. A photomultiplier tube comprising:

an envelope having a faceplate;

a photocathode disposed in said envelope for receiving radiant energy incident on the faceplate of said envelope and providing photoelectrons in response thereto;

a first dynode disposed in said envelope having an input aperture facing said photocathode, an output aperture, and a secondary emissive surface formed between said input and output apertures, said secondary emissive surface being oriented for receiving photoelectrons from said photocathode; and a field isolating mesh disposed over the input aperture of said first dynode, said field isolating mesh including a) a periphery formed of an electrically conductive material for providing an isolating electric field in the vicinity of the input aperture of said first dynode, when energized, and b) a central opening that is dimensioned to provide a maximum unobstructed path from said photocathode to the secondary emissive surface of said first dynode, and said field isolating mesh having at least a first portion thereof in physical contact with said first dynode such that said first portion of said field isolating mesh is at the same electrical potential as said first dynode when energized.

2. A photomultiplier tube as set forth in claim 1 wherein the periphery of said field isolating mesh comprises a support structure and a grid structure extending from said support structure.

3. A photomultiplier tube as set forth in claim 1 wherein the central opening in said field isolating mesh has a shape that is substantially polygonal.

4. A photomultiplier tube as set forth in claim 3 wherein the shape of the central opening in the field isolating mesh is a hexagon.

5. A photomultiplier tube as set forth in claim 3 wherein the shape of the central opening in the field isolating mesh is a square.

6. A photomultiplier tube as set forth in claim 1 wherein the central opening in said mesh is substantially circular in shape.

7. A photomultiplier tube as set forth in claim 1 comprising a focusing electrode mounted in said envelope and disposed around the input aperture of said first dynode.

8. A photomultiplier tube as set forth in claim 7 wherein said focusing electrode comprises a central opening that coincides with the input aperture of said first dynode.

9. A photomultiplier tube as set forth in claim 7 wherein said field isolating mesh is substantially planar and comprises a second portion that is disposed in spaced relation to the input aperture of said first dynode and is spaced in offset relation to said first portion.

10. A photomultiplier tube as set forth in claim 9 wherein said second portion of said field isolating mesh is attached to said focusing electrode.

11. A photomultiplier tube as set forth in claim 1 further comprising:

a second dynode having an input aperture facing the output aperture of said first dynode, an output aperture, and a secondary emissive surface oriented for receiving secondary electrons from said first dynode;

a third dynode having an input aperture facing the output aperture of said second dynode, an output aperture, and a secondary emissive surface oriented for receiving secondary electrons from said second dynode;

a dynode array having an input aperture facing the output aperture of said third dynode and an output aperture, said dynode array being oriented for receiving secondary electrons from said third dynode; and an anode disposed adjacent to the output aperture of said dynode array for receiving secondary electrons from said dynode array.

12. A photomultiplier tube as set forth in claim 1 wherein the central opening in said field isolating mesh is offset relative to the input aperture of said first dynode.

13. A photomultiplier tube comprising:

an envelope having a faceplate;

a photocathode disposed in said envelope for receiving radiant energy incident on the faceplate of said envelope and providing photoelectrons in response thereto;

a first dynode disposed in said envelope having an input aperture facing said photocathode, an output aperture, and a secondary emissive surface formed between said input and output apertures, said secondary emissive surface being oriented for receiving photoelectrons from said photocathode; and a focusing electrode mounted in said envelope and disposed around the input aperture of said first dynode;

a field isolating mesh disposed over the input aperture of said first dynode, said field isolating mesh including:

a) a periphery formed of an electrically conductive material for providing an isolating electric field in the vicinity of the input aperture of said first dynode, when energized, b) a central opening that is dimensioned to provide a maximum unobstructed path from said photocathode to the secondary emissive surface of said first dynode, and said field isolating mesh being formed of two segments including a first segment that is disposed in the input aperture of and in physical contact with said first dynode and a second segment that is disposed in spaced relation to the input aperture and is offset relative to said first segment.

14. A photomultiplier tube as set forth in claim 13 wherein said second segment of said field isolating mesh is attached to said focusing electrode such that said second segment can be energized at the same electrical potential as said focusing electrode.

15. A photomultiplier tube as set forth in claim 13 wherein the central opening in said field isolating mesh has a shape that is substantially polygonal.

16. A photomultiplier tube as set forth in claim 15 wherein the shape of the central opening in the isolating mesh is a polygon selected from the group consisting of hexagons and squares.

17. A photomultiplier tube as set forth in claim 13 wherein the central opening. in said mesh is substantially circular in shape.

18. A photomultiplier tube as set forth in claim 13 wherein the central opening in said field isolating mesh is offset relative to the input aperture of said first dynode.

* * * * *